US005829616A

United States Patent [19]

Daniel et al.

[11] Patent Number: 5,829,616

[45] Date of Patent: Nov. 3, 1998

[54] STACKABLE NESTABLE DISPENSING BIN

[75] Inventors: Aaron E. Daniel, Middleton; Daniel P. Rule, Caldwell, both of Id.

[73] Assignee: Rule Steel Tanks, Inc., Caldwell, Id.

[21] Appl. No.: 650,313

[22] Filed: May 17, 1996

[51] Int. Cl.[6] ..... B65D 6/00

[52] U.S. Cl. ..... 220/4.03; 220/657; 220/651; 206/518; 206/519

[58] Field of Search ..... 206/518, 519, 206/516, 503; 220/4.03, 657, 659, 651

[56] References Cited

U.S. PATENT DOCUMENTS

| | | | |
|---|---|---|---|
| 2,664,219 | 12/1953 | Schmidt . | |
| 3,318,473 | 5/1967 | Jones et al. . | |
| 3,318,486 | 5/1967 | Felix | 206/518 |
| 3,734,335 | 5/1973 | Lincoln . | |
| 4,381,842 | 5/1983 | Dezawa . | |
| 4,512,493 | 4/1985 | Von Holdt | 220/782 |
| 4,756,425 | 7/1988 | Wise | 206/518 |
| 4,826,013 | 5/1989 | Heikkinen | 206/518 |
| 4,854,461 | 8/1989 | Daniel et al. . | |
| 4,913,301 | 4/1990 | Pickler | 206/518 |
| 5,184,748 | 2/1993 | Apps | 206/518 |
| 5,335,789 | 8/1994 | Taravella et al. | 206/518 |
| 5,429,259 | 7/1995 | Robin . | |

*Primary Examiner*—Joseph M. Moy
*Attorney, Agent, or Firm*—Ken J. Pedersen; Barbara S. Pedersen

[57] ABSTRACT

A dispensing bin and cover cooperate to support many times the bin's capacity stacked on the cover. With the cover removed, empty bins nest for storage. Vertical stacking capacity is enhanced by surrounding the top opening of the bin with a reinforcement that maintains the horizontal shape of the top opening. A vertical component of the weight of identical bins stacked on top of the cover is opposed by a horizontal reaction force provided by the reinforcement and communicated to tapered sides. The dispensing aperture has a gate that automatically latches closed and permits sealing by conventional loop tag or tie. The cover has superior strength yet is light in weight so that handling of the cover is feasible by one man without machine assistance. Snap bails are held in place by intrinsic spring tension when stowed against bin sides or snapped onto the cover for retaining the cover to the bin. Snap bails are also used for lifting the full bin.

11 Claims, 5 Drawing Sheets

STACKABLE NESTABLE DISPENSING BIN

BACKGROUND OF THE INVENTION

1. Field of the Invention.

This invention relates to dispensing bins that nest when open and safely stack when closed.

2. Background of the Invention

As an introduction to the problems solved by the present invention, consider the conventional dispensing bin of the type described in U.S. Pat. No. 3,318,473 by B. D. Jones, et. al. Such a dispensing bin has an integral top, barrel cover, protruding lifting eyes, four angular legs, an open frame design with numerous structural members, and an integral hopper and gate apparatus for controlling dispensing.

When used for temporary storage, such as for seed, that bin provides no space economy since it occupies the same amount of space whether in use or empty and not in use. The integral top is made to withstand the concentrated stresses applied by the angular legs of full bins stacked above it. When lifting eyes are bent during use, stacking can become difficult or precarious. Though the interior of the bin may remain clean, dirt accumulates on numerous exposed surfaces. Finally, certification of the contents cannot be maintained because there is no means described for sealing the barrel cover or the gate apparatus.

Consequently, the cost of using such a conventional dispensing bin is high and adds to the cost of products made with its contents. Dispensing bins are used conventionally in agriculture for seed and crop treatment materials and in materials manufacturing for constituent particulates of all types, to name only a few applications.

In view of the problems described above and related problems that consequently become apparent to those skilled in the applicable arts, the need remains in the field of materials handling for an improved dispensing bin that is space efficient, light weight, of high capacity, offering a closed appearance, and sealable for contents quality control.

SUMMARY OF THE INVENTION

Accordingly, a dispensing bin in one embodiment of the present invention includes a body, a base, and a reinforcement for distributing the weight of bins stacked upon it. The body is formed with folded corners defining an interior and an opening into the interior. The base supports the body and defines an aperture through the base. The base and body are dimensioned to nest within a provided identical bin. The reinforcement of the opening provides peripheral support to a provided cover to resist deformation of the cover into the opening.

According to a first aspect of such an embodiment, identical bins. Consequently, empty bins are stored in less space than full bins. Such efficient use of space is economically attractive in seasonal agricultural applications such as use with seed.

According to another aspect, stacking forces are distributed rather than concentrated. The reinforcement distributes the weight of stacked bins by reinforcing the first opening against a component force acting to radially compress the opening. Bins of the present invention use lighter materials and simpler construction techniques while increasing bin strength and capacity.

According to yet another aspect, the body is coupled to the base in a manner permitting a strong, closed, clean appearance. Such features promote long life in the elements and avoid costly misunderstandings of product quality.

A cover for a dispensing bin, in another embodiment of the present invention, includes a sheet and an engagement. The engagement creates a surface tension in the sheet's surface when the cover is placed across an opening of a first provided bin and a second provided bin is stacked on the cover.

According to a first aspect of such a cover, the bin provides an opening surrounded by a reinforcement. The reinforcement provides a reaction force that maintains the shape of the opening. The cover extends across the opening to restrain a provided article stacked on the cover from entering the bin. The engagement distributes a portion of the weight of the provided stacked article into the reinforcement to be opposed by the reaction force.

According to another aspect, such a cover provides improved stacking capacity when constructed of materials lighter than materials used in conventional bin covers. Economic savings result from use of such a cover because the cover can be handled easily by one man without the expense of machine assistance.

In yet another embodiment of the present invention, an aperture of a dispensing bin is closed with a gate and latch. The gate includes a handle. The latch includes a pivot and a hole. The latch pivots to fall against the gate.

According to a first aspect of such an embodiment, the hole in the latch can be secured to the handle with a conventional loop tie to seal the bin against unauthorized dispensing. According to a second aspect, the latch automatically prevents unexpected reopening of the gate whenever the gate is fully closed. According to another aspect, the handle permits opening of the gate by means of a rope tie when the gate is out of reach of an operator. Remote operation of the gate improves operator safety.

In still another embodiment, a dispensing bin includes a plurality of bails, formed of spring material, that pivot between two stable positions. According to a first aspect of such an embodiment, the bails support the bin for lifting the bin and hold the cover onto the bin. Separate lifting eyes are avoided. In addition, the second stable position reduces marring of the bin's exterior surface and protects the bail from damage.

These and other embodiments, aspects, advantages, and features of the present invention will be set forth in part in the description which follows, and in part will become apparent to those skilled in the art by reference to the following description of the invention and referenced drawings or by practice of the invention. The aspects, advantages, and features of the invention are realized and attained by means of the instrumentalities, procedures, and combinations particularly pointed out in the appended claims.

A person having ordinary skill in the art will recognize where portions of a diagram have been expanded to improve the clarity of the presentation.

DETAILED DESCRIPTION OF THE INVENTION

Figure 1:
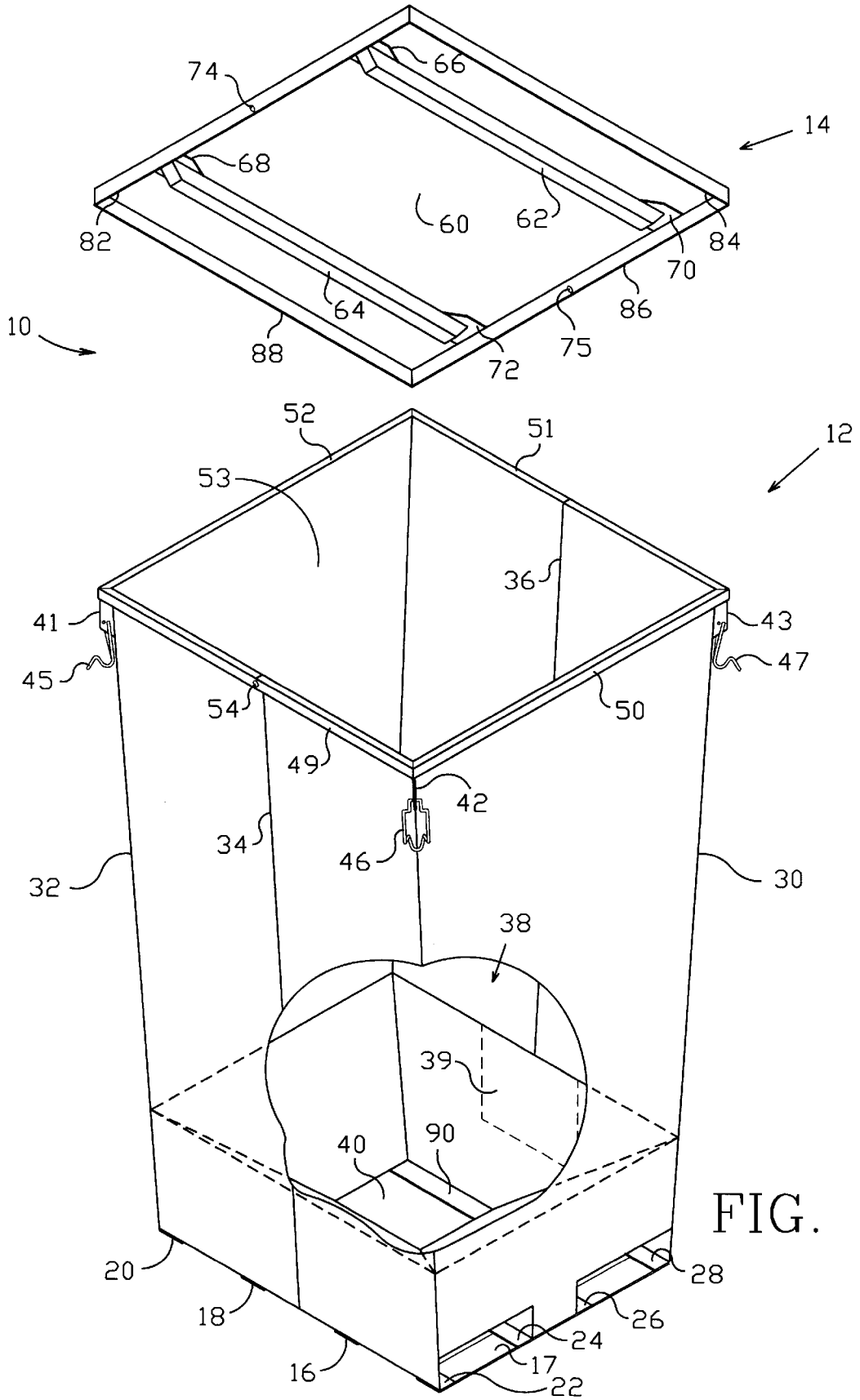
FIG. 1 is an exploded perspective view of one embodiment of a dispensing bin and cover of the present invention, showing the bottom surface of the cover.

FIG. 1 is an exploded perspective view of a dispensing bin and cover of the present invention. Container 10 includes bin 12 and cover 14 generally of sheet steel construction with welded bar, tube, plate, and angle members to be discussed. Bin 12 includes a base, a body, and a reinforcement. The base is built up from flat bars 17, 16, 18, and 20 welded in cross-wise relation to formed channels 22, 24, 26, and 28. Additional stiffeners, not shown, are welded cross-wise on top of formed channels 22, 24, 26, and 28 to provide surfaces for lifting bin 12. A passage between channels 24 and 26 and between bars 16 and 18 allows the dispensing of bin 12 contents through opening 40. Openings between formed channel pairs 22-24 and 26-28 admit the tines of fork truck and pallet jack equipment for lifting bin 12 and for rotating bin 12 to dump its contents from opening 53.

Figure 5:
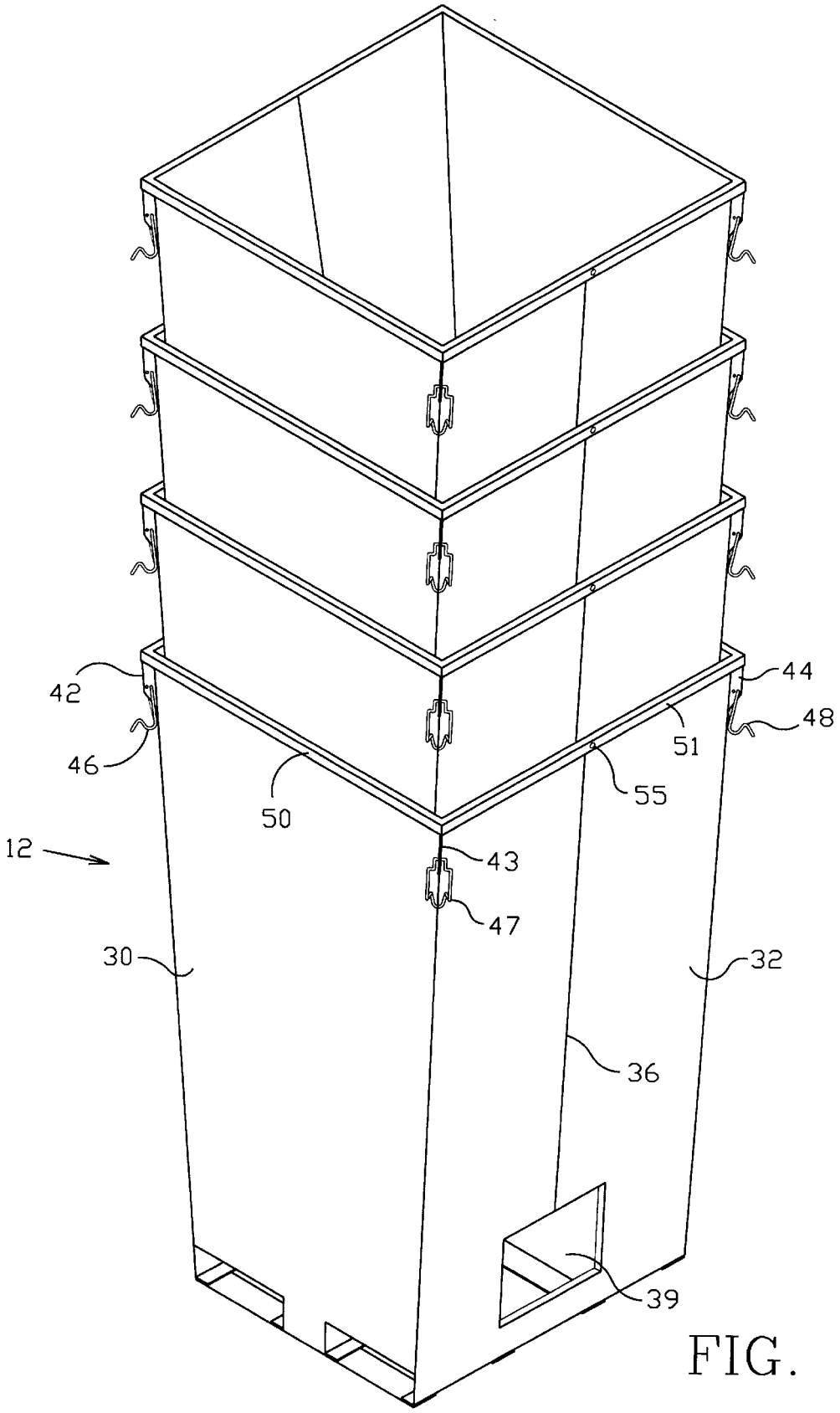
FIG. 5 is a perspective view of a plurality of the dispensing bins of FIG. 1, nested without covers.

The body includes two sides and a funnel-shaped hopper. Sides 30 and 32 are joined together at vertical lap seams 34 and 36. Each side is of the type described in U.S. Pat. No. 4,854,461 to Daniel et al., being tapered and having folded rather than welded vertical corners. The mouth of hopper 38 is welded to the interior surfaces of sides 30 and 32. Because sides 30 and 32 are tapered inward from top to bottom to provide opening 53 larger than the mouth of hopper 38, identical bins nest together for compact storage as shown in FIG. 5. When nested, bars 17, 16, 18, and 20 rest just inside the mouth of hopper 38. Opening 40 in hopper 38 is closed by operation of a manually operated gate accessed through opening 39.

Opening 53 is reinforced by angles 49, 50, 51, and 52 welded to sides 30 and 32 in a picture frame configuration that includes corner bail mount tabs. Bail mount tabs 41, 42, 43, and 44 are welded respectively to each of the four corners of bin 12. The picture frame construction of the reinforcement has two alternate configurations. In a first configuration angles 49 and 50 are joined together at a 45 degree welded corner. Then tab 42 is welded to the inside surfaces of the 45 degree corner. In a second configuration, a three element corner is constructed by welding angle 49 to one side of tab 42 and welding angle 50 to the opposite side. The second configuration is preferred when angles 49 and 50 are cut from extruded angle stock having an interior cove, as opposed to forming each angle from bar stock on a brake. The function of the reinforcement will be described below with reference to FIG. 2.

Cover 14 includes sheet 60, tubes 62 and 64, tabs 66, 68, 70, and 72, and engagement flanges 82, 84, 86, and 88. Sheet 60 is folded and hemmed to form the engagement flanges. Two braces are used as stiffeners. Each brace has two tabs and one tube. The tabs are first welded to the tube and then the assembled brace is welded to the interior surface of sheet 60. In a preferred embodiment, the tube is welded to sheet 60 along its length on both corners nearest sheet 60.

By virtue of the above construction, bin 12 has an unobstructed, smooth interior. When loaded with material through opening 53, bin 12 dispenses its entire material contents through opening 40, leaving no residual material or debris caught on any interior surface. When nested and stacked upside-down, multiple bins are assured to be clean and completely empty when removed from storage. Except for openings for latch access and fork tines, bin 12 has a completely closed, clean exterior as well. When turned upright for use, the few remaining surfaces that may have collected airborne dust and debris are not readily apparent. Interior and exterior cleanliness is often of great economic importance in applications of dispensing bins.

Figure 2:
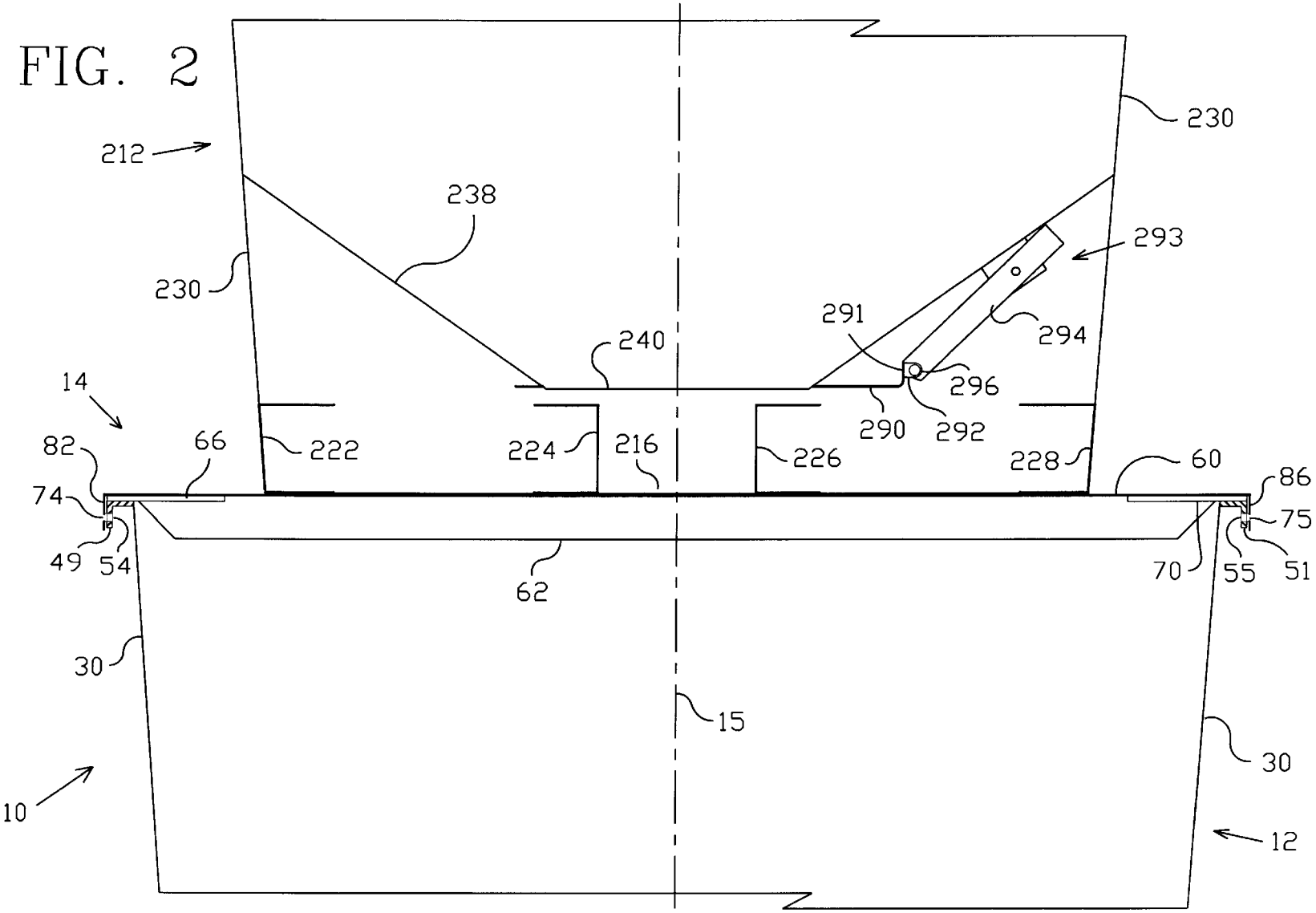
FIG. 2 is a cross-section of a top portion of the bin shown in FIG. 1 with the cover in place and another identical bin stacked on the cover.

FIG. 2 is a cross-section of a top portion of a bin 12 with cover 14 in place and an identical bin 212 stacked on cover 14. For bin 212, components identified by numerals correspond to identical components identified by numerals used in bin 12, merely distinguished by the addition of 200 to the numeral value. Cover 14 is placed over opening 53 of bin 12. The inside surfaces of engagement flanges 82 and 86 fit snugly over reinforcement angles 49 and 51, respectively. Axis 15 is shown passing vertically through both the center of opening 53 in bin 12 and through the center of aperture 240. Note that engagement flanges 82 and 86 and angles 49 and 51 are in contact on a vertical surface parallel to axis 15. The length of the perimeter of the vertical contact surface is greater than the length of the perimeter of opening 53.

In operation, cover 14 is not adversely deformed from its generally planar shape under the routine load of as many as 4 full bins stacked on top of it. Yet cover 14, constructed of common steel materials, is light enough to be easily handled by one man without machine assistance. Such strength is due in part to the cooperation of cover 14 with the reinforcement and tapered sides of bin 12. The combined weight of bin 212 and bins stacked on top of bin 212, exerts a vertically downward force on sheet 60 of cover 14. Because sheet 60 is supported at its periphery by vertical engagement flanges 82 and 86, a surface tension is created in sheet 60 as sheet 60 is stretched and depressed into opening 53. Engagement flanges 82 and 86 cooperate with reinforcement angles 49 and 51 to transform the vertically downward force into horizontal components that press inwardly on reinforcement angles 49 and 51. The combined weight is effectively mechanically communicated to side walls 30 and 32 of bin 12. The strength of the reinforcement is at a maximum in the horizontal compressive direction due in part to the picture frame construction discussed above.

Opening 240 in hopper 238 is closed by gate 290. Gate 290 includes lip 291 and finger pull 292. As shown in its closed position, gate 290 is blocked from sliding to the right by latch assembly 293. Latch assembly 293 includes bar 294 having one end blocking lip 291 and the other end resting on the underside hopper 238. Gravity causes bar 294 to take this blocking position automatically when gate 290 is closed.

Bin 12 is sealable to protect its contents. Bar 294 includes hole 296 near finger pull 292 for attaching a conventional sealing loop or tag seal. Cover 14 is sealed to bin 12 by passing a conventional sealing loop or tag seal through aligned holes. Holes 54 and 55 in bin 12 align with holes 74 and 75 respectively in cover 14.

Figure 3:
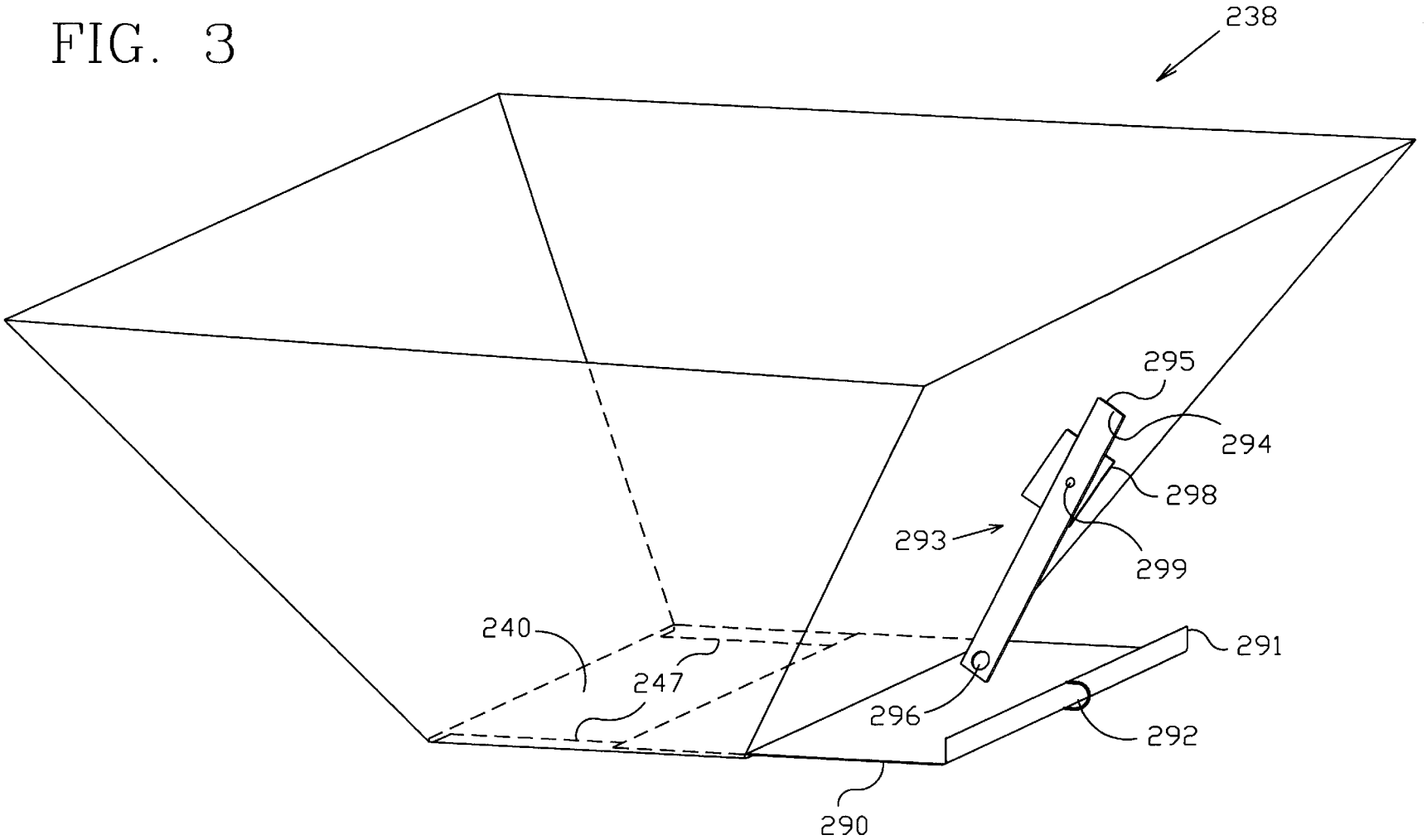
FIG. 3 is a perspective view of a lower portion of the bin shown in FIG. 1 with the gate opened.

FIG. 3 is a perspective view of hopper 238 and latch assembly 293 shown in FIG. 2. Gate 290 slides on supports 247. In FIG. 3, gate 290 is in the open position. In addition to the elements discussed above, latch assembly 293 includes tab 298 and pivot fastener 299. Tab 298 is welded to the under side of hopper 238. Bar 294 is permanently attached by pivot fastener 299 to pivot on tab 298. In operation, to open gate 290, bar end 295 is manually pulled away from hopper 238 to clear lip 291. When released, bar 291 rests against the underside of hopper 238. As gate 290 is closed, bar 294 follows over lip 291 and comes to rest to automatically block further movement of gate 290.

Figure 4C:
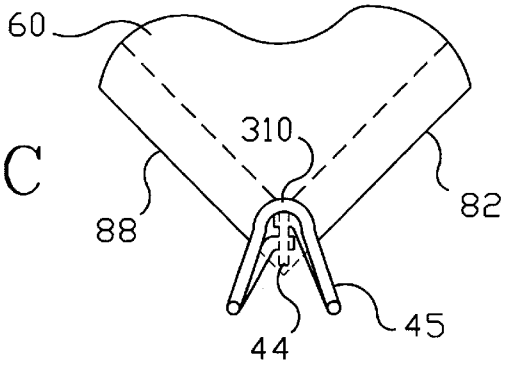
FIGS. 4A, 4B, and 4C are side, front, and top views of a bail shown in FIG. 1.
Figure 4B:
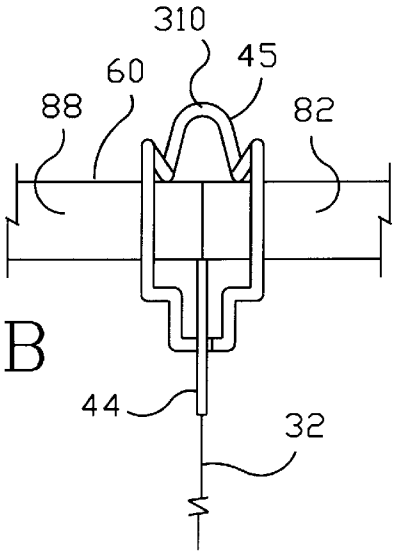
Figure 4A:
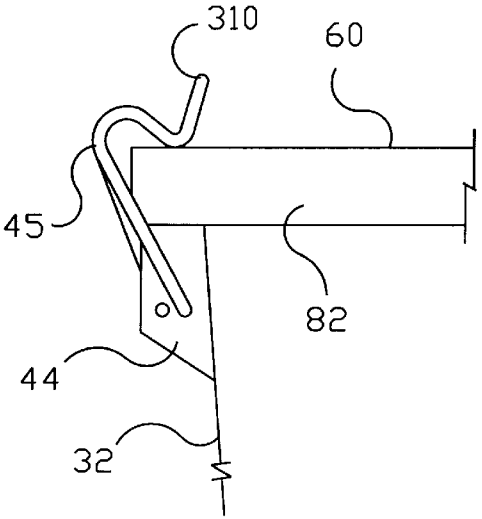

FIGS. 4A, 4B, and 4C are side, front, and top views of bail 45 shown in FIG. 1. Bail 45 is typical of bails 46 and 47 shown in FIG. 1 and bail 48 on the far corner, shown in FIG. 5. Bails 45, 46, 47, and 48 are made of spring steel and each mount in two holes in a respective bail mount tab 41, 42, 43, shown in FIG. 1, and 44, shown in FIG. 5.

Bails 45, 46, 47, and 48 perform two functions. As illustrated, these bails hold cover 14 in position on bin 12 across opening 53. Because these bails admit lifting ropes or hooks, for example, under loop 310, these bails support bin 12 when suspended and when bin 12 is either empty or full.

By virtue of the illustrated bail shape, a residual tension remains in bail 45 which permits only two stable positions regardless of the orientation of bail 45 with respect to gravity. The first position, when stowed, leaves bail 45 firmly pressed against a corner of the respective side 30 or 32, so that bail 45 is less likely to mar the finish of the side during transportation of bin 12. In this position, bail 45 is protected from damaging other surfaces when bins are nested, inverted, or placed side-by-side. After cover 14 is placed on bin 12, bail 45, is snapped to a second stable position, shown in FIGS. 4A, 4B, and 4C. In the second position, bail 45 holds cover 14 in place across opening 53 on bin 12.

Bail 45 pivots within two holes in bail mounting tab 41. The location of the holes depends on application design choices including the sheer strength and spring constant of the materials selected from which to form bail 45 and tab 41, the weight of a full dispensing bin, and the required cover holding force in the various orientations of a full dispensing bin.

In a preferred embodiment, bin 12 is constructed for dispensing seed. Bin 12, constructed from sheet steel gauge A569 and plate and structural members of gauge A36, measures approximately 60 inches high by 54 inches long by 45 inches wide and weighs less than 300 pounds. Bin 12 has a capacity of over 60 cubic feet, stores from 2,000 to 4,000 pounds of seed and dispenses its contents through a 6 inch by 12 inch gate opening. Each nested bin adds about 14 inches of stack height. Cover 14, constructed of 20 gauge material with 3/16th inch thick tabs and 2 inch square tubes having 0.083 inch wall thickness, weighs about 65 pounds, and safely supports about 13,000 pounds stacked on top of it when it is properly installed on bin 12. Reinforcement angle is made from ¼ inch thick material bent into an angle having legs of 1.25 inches by 1.25 inches.

All U.S. patents cited in this description are hereby incorporated by this reference for any purpose including additional background and description of materials, functions, and techniques known in the art.

The foregoing description discusses preferred embodiments of the present invention, which may be changed or modified without departing from the scope of the present invention.

For example, the rectangular aspect of the bin interior in other equivalent embodiments is square, triangular, circular, elliptical, or another shape selected for ease of manufacture, desired bin contents, capacity, and economic factors. In these embodiments one or more side pieces form the aspect and are tapered inward from top to bottom for nesting, strengthening, and capacity.

Further, in alternate embodiments, not shown, the engagement and reinforcement cooperate in various known varieties of mechanical contact. For example, engagement and reinforcement in alternate and equivalent embodiments use channel and nesting bar or tube, pin and hole, or tab and slot techniques.

Still further, those skilled in the art will understand that lighter bins of the present invention are constructed using plastic molding, extruding, forming, and joining techniques known in the art either alone or in combination with metals, composites, and other known materials. Materials selection, reliance on standardized shapes, and various joining techniques are mere design choice. Joining includes but is not limited to welding, adhering, and use of fasteners.

These and other changes and modifications are intended to be included within the scope of the present invention. While for the sake of clarity and ease of description, several specific embodiments of the invention have been described; the scope of the invention is intended to be measured by the claims as set forth below. The description is not intended to be exhaustive or to limit the invention to the form disclosed. Other embodiments of the invention will be apparent to one of ordinary skill in the art to which the invention applies in light of the disclosure and by practice of the invention.

What is claimed is:

1. A dispensing bin comprising:

a. a body comprising a sidewall having a top and a bottom, the body defining an interior and defining an opening into the interior near the top of the sidewall;

b. a base that supports the body, the base defining an aperture for dispensing through the base material contained in the body interior, the base and the body being dimensioned to nest within a provided identical bin; and c. a reinforcement of the opening, the reinforcement comprising a horizontal member extending outward from said top of the sidewall, and a vertical member extending downward from the horizontal member and having a generally vertical outer surface and an inner surface, wherein the vertical member inner surface is spaced from the sidewall; and d. a cover removably installed on top of the bin over the opening, the cover comprising a generally horizontal sheet and an engagement flange, the sheet having a top surface, a bottom surface and an outer perimeter and the sheet extending substantially across the entire bin opening to enclose the bin and across the reinforcement horizontal member:

wherein the engagement flange extends generally vertically downward from the sheet outer perimeter and has an outer surface and an inner surface generally parallel to and contacting the generally vertical outer surface of the reinforcement vertical member outer surface; and wherein contact of the engagement flange and the reinforcement vertical member provides peripheral support to the cover and creates a tension within the cover sheet to resist deformation of the cover into the opening when a second provided bin is stacked on the cover.

2. The bin of claim 1 wherein the body sidewall further comprises at least two folded corners.

3. The bin of claim 1 wherein the body further comprises a hopper over the aperture in the base aligned for dispensing material from the body through the aperture.

4. The bin of claim 1 wherein the base further defines at least two channel openings adapted to receive forklift tines for lifting the bin without obstructing the aperture.

5. The bin of claim 1 wherein the reinforcement is continuous around the opening.

6. The bin of claim 2 further comprising a plurality of bails at the corners of the body, the bails being for lifting the bin and for holding the cover across the opening, wherein the plurality comprise a bail comprising a spring means for biasing the bail into two stable positions, a first position down against the bin sidewall and a second position contacting the top surface of the cover sheet to hold the cover across the opening.

7. The bin of claim 6 wherein the bail, when operated to move between the first and the second stable positions, pivots at a first pivot point and at a second pivot point comprising a mounting tab extending out from the bin sidewall and two offset holes in the mounting tab.

8. The container of claim 1 wherein the cover comprises a brace joined to the sheet for resisting deformation of the sheet, wherein the brace comprises spaced first and second plates, each plate joined to the bottom surface of the sheet and contacting the horizontal member of the bin reinforcement, and a tube having first and second ends joined respectively to the plates.

9. The bin of claim 8 wherein the tube is joined to the bottom surface of the sheet in addition to being joined to the plates.

10. The bin of claim 3, wherein the hopper further comprises:

an outer side surface;

a hopper bottom opening;

a gate slidably held across said bottom opening; and a latch assembly including a generally vertical rigid bar having a top end and a bottom end, the bar pivotally connected between the top end and bottom end to the outer side surface of the hopper;

wherein the latch assembly is adapted so that gravity pivots the bar to place the top end in contact with the hopper outer side surface and the bar bottom end in position to prevent the gate from sliding out from the hopper bottom opening; and wherein the latch assembly bar is adapted to allow the bar to be swung to place the bar bottom end close to the hopper outer side surface to raise the bar bottom end and allow the gate to be slid out from the hopper to open the hopper bottom opening.

11. A dispensing bin comprising:

a. a body comprising a sidewall having a top and a bottom, the body defining an interior and defining an opening into the interior near the top of the sidewall;

b. a base that supports the body, the base defining an aperture for dispensing through the base material contained in the body interior, the base and the body being dimensioned to nest within a provided identical bin; and c. a reinforcement of the opening extending continuously around the opening, the reinforcement consisting of a horizontal member extending outward from said top of the sidewall, and a vertical member extending downward from the horizontal member and having a generally vertical outer surface and an inner surface, wherein the vertical member inner surface is spaced from the sidewall; and d. a cover removably installed on top of the bin over the opening, the cover comprising a generally horizontal sheet and an engagement flange extending continuously around the sheet, the sheet having a top surface, a bottom surface and an outer perimeter and the sheet extending substantially across the entire bin opening to enclose the bin and across the reinforcement horizontal member;

wherein the engagement flange extends generally vertically downward from the sheet outer perimeter and has an outer surface and an inner surface generally parallel to and contacting the generally vertical outer surface of the reinforcement vertical member outer surface; and wherein contact of the engagement flange and the reinforcement vertical member provides peripheral support to the cover and creates a tension within the cover sheet to resist deformation of the cover into the opening when a second provided bin is stacked on the cover.

* * * * *